US010434377B1

(12) United States Patent
Tindall

(10) Patent No.: US 10,434,377 B1
(45) Date of Patent: Oct. 8, 2019

(54) SPORTS BALL STORAGE DEVICE

(71) Applicant: John Tindall, St. Louis, MO (US)

(72) Inventor: John Tindall, St. Louis, MO (US)

( * ) Notice: Subject to any disclaimer, the term of this patent is extended or adjusted under 35 U.S.C. 154(b) by 113 days.

(21) Appl. No.: 15/831,521

(22) Filed: Dec. 5, 2017

(51) Int. Cl.
*B65D 85/00* (2006.01)
*A63B 47/00* (2006.01)

(52) U.S. Cl.
CPC ..... *A63B 47/002* (2013.01)

(58) Field of Classification Search
CPC ..... A63B 47/002
USPC ..... 206/315.1, 315.9; 211/14, 85.17, 85.18, 211/87.01, 106; 220/476, 480, 481
See application file for complete search history.

(56) References Cited

U.S. PATENT DOCUMENTS 3,371,795 A 3/1968 Rosonke
4,781,307 A * 11/1988 Ferro ..... A63B 47/002 221/131
5,533,646 A * 7/1996 Dildine ..... A63B 47/002 221/185
5,894,951 A * 4/1999 Hunt ..... A63B 47/007 206/315.9
6,267,461 B1 * 7/2001 Dunagan ..... A63B 47/002 312/49
6,481,595 B1 * 11/2002 Chilton ..... A63B 47/002 221/185
D497,750 S * 11/2004 Ruffell ..... D6/515
D564,266 S * 3/2008 Goodman ..... D6/515
7,398,888 B1 * 7/2008 Nowak ..... A63B 71/0036 211/59.2
D600,962 S 9/2009 St. Peter
7,789,250 B2 9/2010 Aamodt
7,806,259 B2 10/2010 Gregory
2006/0113316 A1 6/2006 Kilgore
2006/0186000 A1 * 8/2006 Gregory ..... A63B 71/0045 206/315.9

FOREIGN PATENT DOCUMENTS

GB 296835 9/1928

* cited by examiner

*Primary Examiner* — Luan K Bui
(74) *Attorney, Agent, or Firm* — Kyle A. Fletcher, Esq.

(57) ABSTRACT

The sports ball storage device is configured for use in storing one or more balls. The sports ball storage device attaches to a vertical surface. The sports ball storage device dispenses a ball selected from the one or more balls. The sports ball storage device comprises a cage, a door, and a plurality of mounting brackets. The plurality of mounting brackets attach the cage to the vertical surface. The door attaches to the cage. The cage is a hollow cylindrical openwork structure that attaches to the vertical surface such that the center axis of the cylindrical openwork structure is parallel to the force of gravity. The one or more balls are placed into the cage through the superior end of the hollow cylindrical openwork structure. The one or more balls are dispensed through the door of the sports ball storage device.

15 Claims, 5 Drawing Sheets

SPORTS BALL STORAGE DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of human necessities including apparatus for physical training, a device for storing and dispensing balls from a reservoir.

SUMMARY OF INVENTION

The sports ball storage device is configured for use with one or more balls. The sports ball storage device attaches to a vertical surface such as a wall. The sports ball storage device stores the one or more balls. The sports ball storage device dispenses a ball selected from the one or more balls. The sports ball storage device comprises a cage, a door, and a plurality of mounting brackets. The plurality of mounting brackets attaches the cage to the vertical surface. The door attaches to the cage. The cage is a hollow cylindrical openwork structure that attaches to the vertical surface such that the center axis of the cylindrical openwork structure is parallel to the force of gravity. The one or more balls are placed into the cage through the superior end of the hollow cylindrical openwork structure. The one or more balls are dispensed through the door of the sports ball storage device.

These together with additional objects, features and advantages of the sports ball storage device will be readily apparent to those of ordinary skill in the art upon reading the following detailed description of the presently preferred, but nonetheless illustrative, embodiments when taken in conjunction with the accompanying drawings.

In this respect, before explaining the current embodiments of the sports ball storage device in detail, it is to be understood that the sports ball storage device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sports ball storage device.

It is therefore important that the claims be regarded as including such equivalent construction insofar as they do not depart from the spirit and scope of the sports ball storage device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
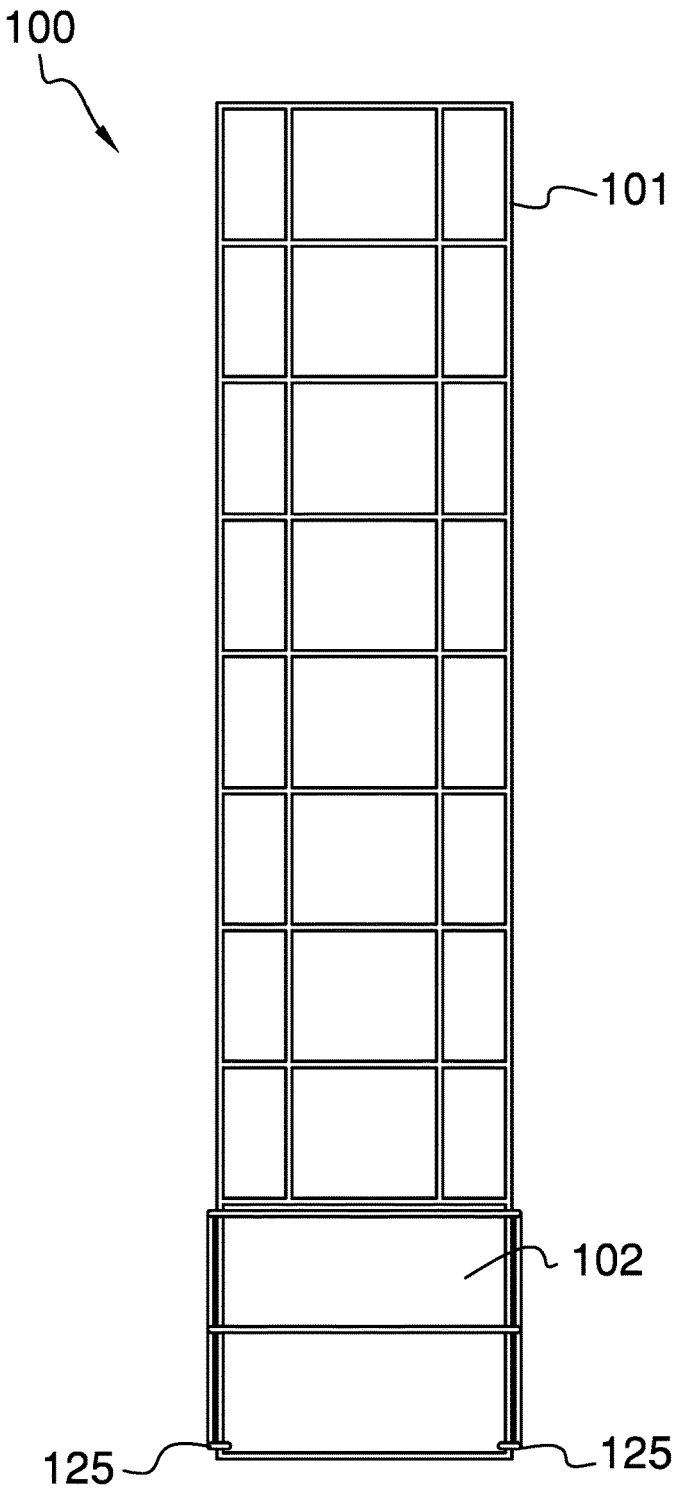
FIG. 1 is a front view of an embodiment of the disclosure.
Figure 2:
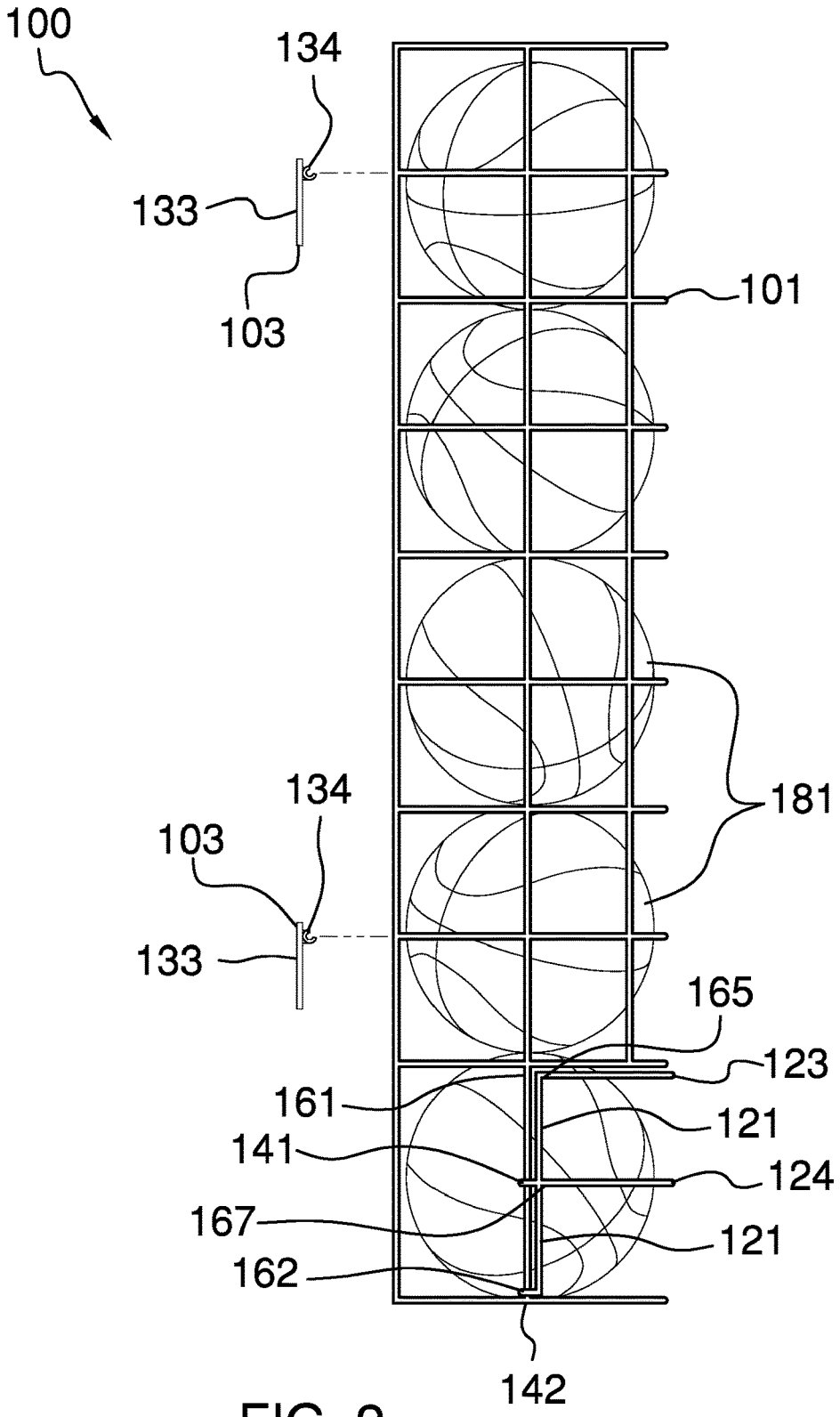
FIG. 2 is a side view of an embodiment of the disclosure.
Figure 3:
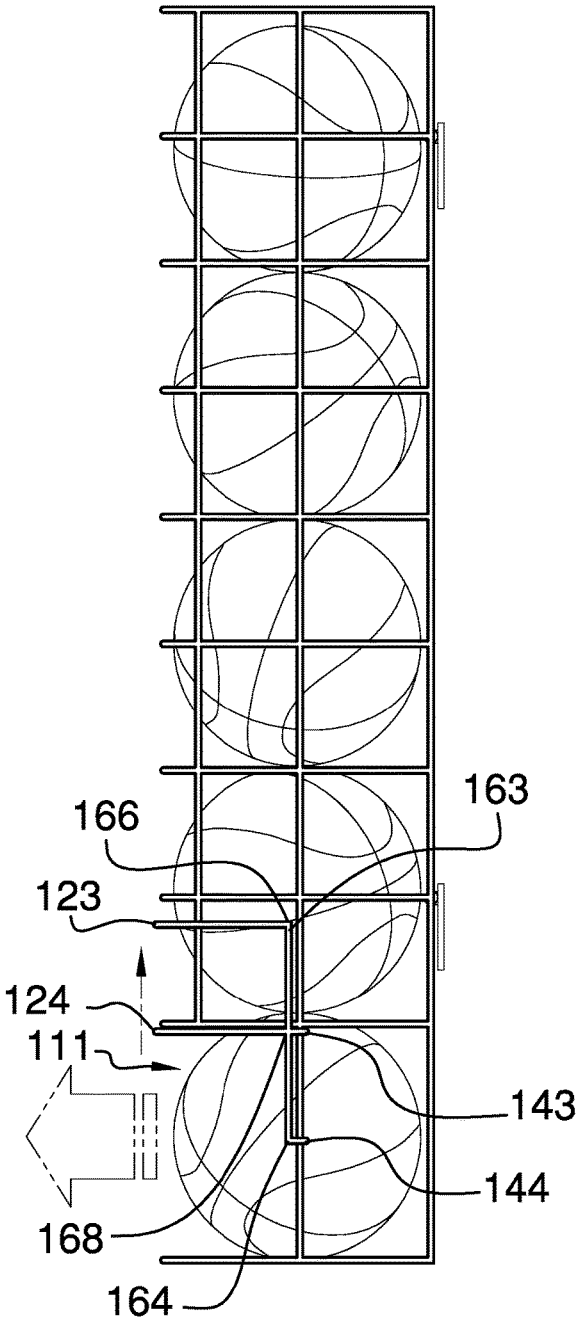
FIG. 3 is a reverse side view of an embodiment of the disclosure.
Figure 4:
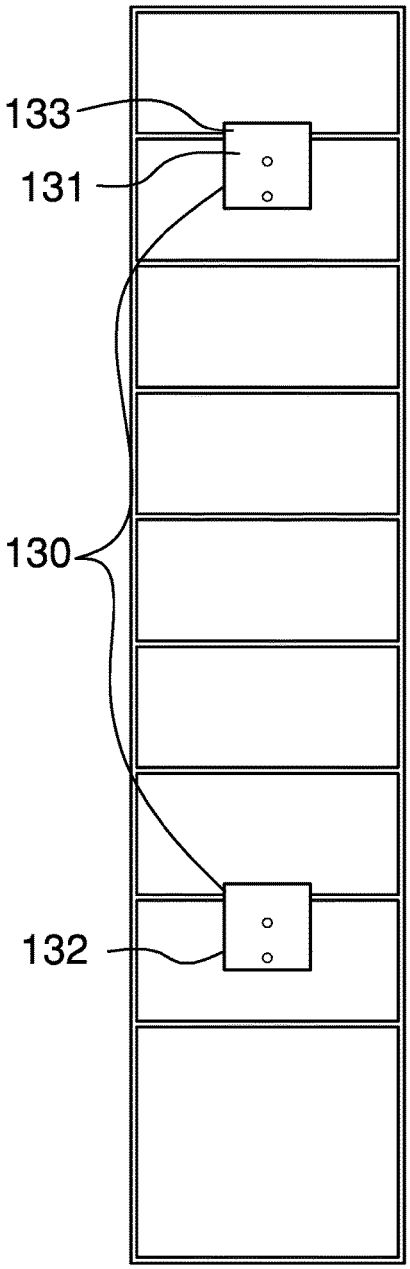
FIG. 4 is a rear view of an embodiment of the disclosure.
Figure 5:
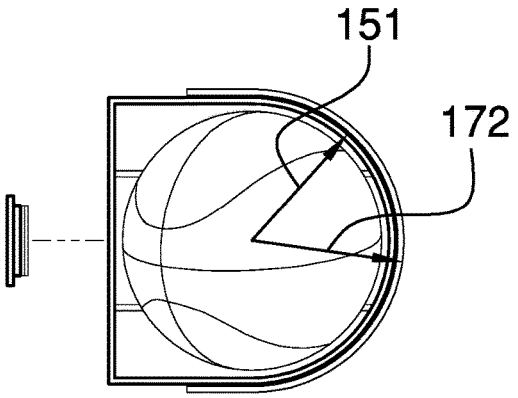
FIG. 5 is a top view of an embodiment of the disclosure.
Figure 6:
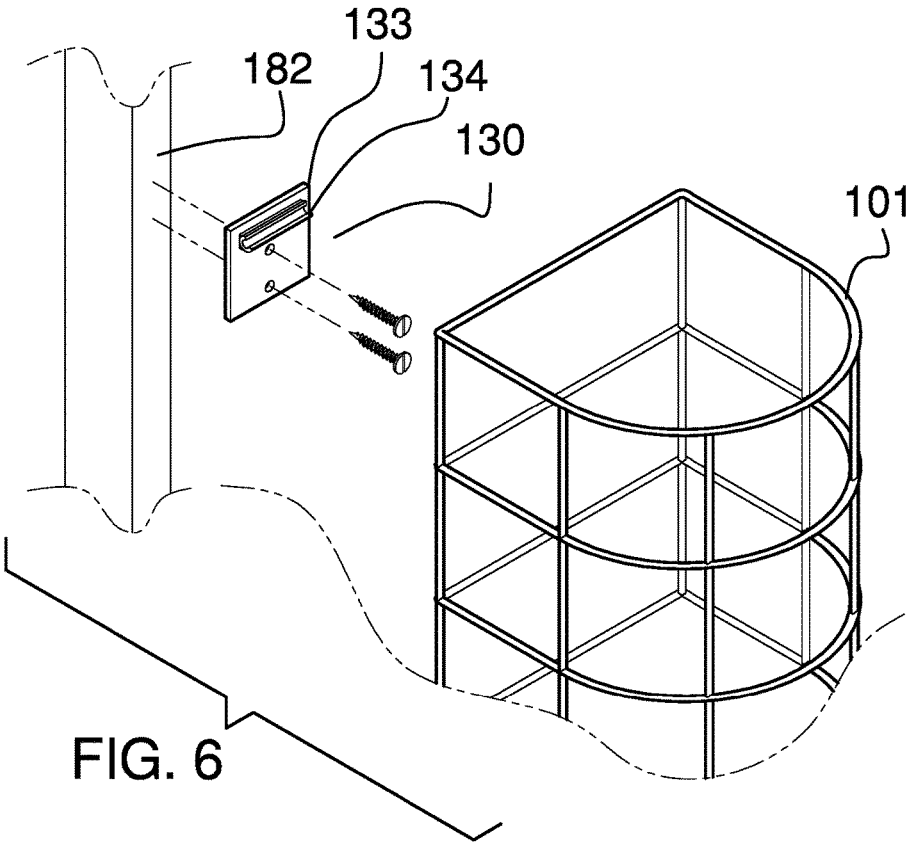
FIG. 6 is a detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The sports ball storage device 100 (hereinafter invention) is configured for use with one or more balls 181. The invention 100 attaches to a vertical surface 182 such as a wall. The invention 100 stores the one or more balls 181. The invention 100 dispenses a ball selected from the one or more balls 181. The invention 100 comprises a cage 101, a door 102, and a plurality of mounting brackets 103. The plurality of mounting brackets 103 attaches the cage 101 to the vertical surface 182. The door 102 attaches to the cage 101. The cage 101 is a hollow cylindrical openwork structure that attaches to the vertical surface 182 such that the center axis 155 of the cylindrical openwork structure is parallel to the force of gravity. The one or more balls 181 are placed into the cage 101 through the superior end 153 of the hollow cylindrical openwork structure. The one or more balls 181 are dispensed through the door 102 of the invention 100.

The cage 101 is a hollow cylindrical openwork structure. The one or more balls 181 are inserted into the hollow interior of the cage 101 through the open superior end 153 of the cage 101. In ideal circumstances, the one or more balls 181 stack within the cage such that the center of the sphere that forms each of the one or more balls 181 aligns with the center axis 155 of the cage 101. The cage 101 mounts on a vertical surface 182 such that the center axis 155 of the cage 101 aligns with the force of gravity. The force of gravity pulls each of the one or more balls 181 to the inferior end 154 of the cage 101 for distribution. The cage 101 further comprises a door 102 aperture 111. The cage 101 is further defined with a first inner radius 151, a lateral face 152, a superior end 153, an inferior end 154, and a center axis 155.

The door 102 aperture 111 is an opening formed through the openwork of the lateral face 152 of the cage 101. The door 102 aperture 111 is located at the inferior end 154 of the cage 101. The door 102 aperture 111 forms the exit port through which the one or more balls 181 exit the cage 101. The span of the dimensions of the door 102 aperture 111 are greater than two times the span of the first inner radius 151 such that a ball selected from the one or more balls 181 will fit through the door 102 aperture 111.

The door 102 is a barrier that encloses the door 102 aperture 111. The door 102 contains the one or more balls 181 within the cage 101 until the one or more balls 181 are ready for distribution. The door 102 is formed in a shape that is geometrically similar to the vertical segment of a cylinder. The door 102 further comprises a first arm 121, a second arm 122, a superior rim 123, an inferior rim 124, and a plurality of rings 125. The plurality of rings 125 comprises a first ring 141, a second ring 142, a third ring 143, and a fourth ring 144.

The first arm 121 is further defined with a first end 161 and a second end 162. The second arm 122 is further defined with a third end 163 and a fourth end 164. The superior rim 123 is further defined with a fifth end 165, a sixth end 166, and a second inner radius 172. The inferior rim 124 is further defined with a seventh end 167, an eighth end 168, and the second inner radius 172.

The second inner radius 172 of the door 102 is greater than the first inner radius 151 of the cage 101 such that the door 102 will wrap around the exterior of the lateral face 152 of the cage 101. The door 102 attaches to the openwork of the cage 101 such that the door 102 slides along the openwork of the door 102 in a direction parallel to the center axis 155 of the cage 101.

The first arm 121 is a cylindrical shaft that forms a portion of the perimeter of the door 102. The first arm 121 is a straight structure. The first arm 121 is parallel to the center axis 155 of the cage 101 when the door 102 is installed on the cage 101. The first arm 121 attaches the superior rim 123 to the inferior rim 124. The first arm 121 attaches the door 102 to the openwork of the cage 101.

The second arm 122 is a cylindrical shaft that forms a portion of the perimeter of the door 102. The second arm 122 is a straight structure. The second arm 122 is parallel to the center axis 155 of the cage 101 when the door 102 is installed on the cage 101. The second arm 122 attaches the superior rim 123 to the inferior rim 124. The second arm 122 attaches the door 102 to the openwork of the cage 101.

The superior rim 123 forms the superior edge of the door 102. The superior rim 123 is a cylindrical shaft that forms a portion of the perimeter of the door 102. The superior rim 123 is a curved structure that forms the arc of the circumference of a circle with a radius equal to the second inner radius 172. The superior rim 123 is perpendicular to the center axis 155 of the cage 101 when the door 102 is installed on the cage 101. The fifth end 165 of the superior rim 123 attaches perpendicularly to the first end 161 of the first arm 121. The sixth end 166 of the superior rim 123 attaches perpendicularly to the third end 163 of the second arm 122.

The inferior rim 124 is a cylindrical shaft. The inferior rim 124 is a curved structure that forms the arc of the circumference of a circle with a radius equal to the second inner radius 172. The inferior rim 124 is identical to the superior rim 123. The inferior rim 124 is perpendicular to the center axis 155 of the cage 101 when the door 102 is installed on the cage 101. The seventh end 167 of the inferior rim 124 attaches perpendicularly to the lateral exterior face of the first arm 121. The eighth end 168 of the inferior rim 124 attaches perpendicularly to the lateral exterior face of the second arm 122.

Each of the plurality of rings 125 is a loop that attaches an arm selected from the group consisting of the first arm 121 and the second arm 122 to the openwork of the cage 101. The door 102 attaches to the cage 101 by inserting a bar of the openwork that forms the cage 101 through a ring selected from the plurality of rings 125. The plurality of rings 125 attach the door 102 to the cage 101 such that the door 102 will slide in a direction that is parallel to the center axis 155 of the cage 101.

The first ring 141 is a loop selected from the plurality of plurality of rings 125 that attaches to the lateral exterior face of the first arm 121 proximal to the seventh end 167 of the inferior rim 124. The first ring 141 attaches to the side of the first arm 121 that is proximal to the center of the circle that forms the circular arcs of the superior rim 123 and the inferior rim 124. The face formed by the first ring 141 is perpendicular to the center axis 155 of the cage 101.

The second ring 142 is a loop selected from the plurality of plurality of rings 125 that attaches to the second end 162 of the first arm 121. The second ring 142 attaches to the second end 162 of the first arm 121 at a location proximal to the center of the circle that forms the circular arcs of the superior rim 123 and the inferior rim 124. The face formed by the second ring 142 is perpendicular to the center axis 155 of the cage 101.

The third ring 143 is a loop selected from the plurality of plurality of rings 125 that attaches to the lateral exterior face of the second arm 122 proximal to the eighth end 168 of the inferior rim 124. The third ring 143 attaches to the side of the second arm 122 that is proximal to the center of the circle that forms the circular arcs of the superior rim 123 and the inferior rim 124. The face formed by the third ring 143 is perpendicular to the center axis 155 of the cage 101.

The fourth ring 144 is a loop selected from the plurality of plurality of rings 125 that attaches to the fourth end 164 of the second arm 122. The fourth ring 144 attaches to the fourth end 164 of the second arm 122 at a location is proximal to the center of the circle that forms the circular arcs of the superior rim 123 and the inferior rim 124. The face formed by the fourth ring 144 is perpendicular to the center axis 155 of the cage 101.

Each of the plurality of mounting brackets 103 is a bracket that attaches the cage 101 to the vertical surface 182 such that the load path of the cage 101 transfers to the vertical surface 182. Each of the plurality of mounting brackets 103 attaches to the openwork of the cage 101. The plurality of mounting brackets 103 comprises a plurality of individual plates 130. Each individual plate 130 is identical.

The individual plate 130 is a plate selected from the plurality of mounting brackets 103. Each individual plate 130 selected from the plurality of mounting brackets 103 is identical to any second individual plate 130 selected from the plurality of mounting brackets 103. Each individual plate 130 comprises a base plate 133 and a hook 134.

The base plate 133 is a rectangular plate structure that distributes a portion of the load generated by the cage 101 over a surface area of the vertical surface 182. The base plate 133 attaches to the vertical surface 182. The hook 134 is a curved structure, which suspends the cage 101. The hook 134 attaches to and supports the openwork of the cage 101.

Figure 7:
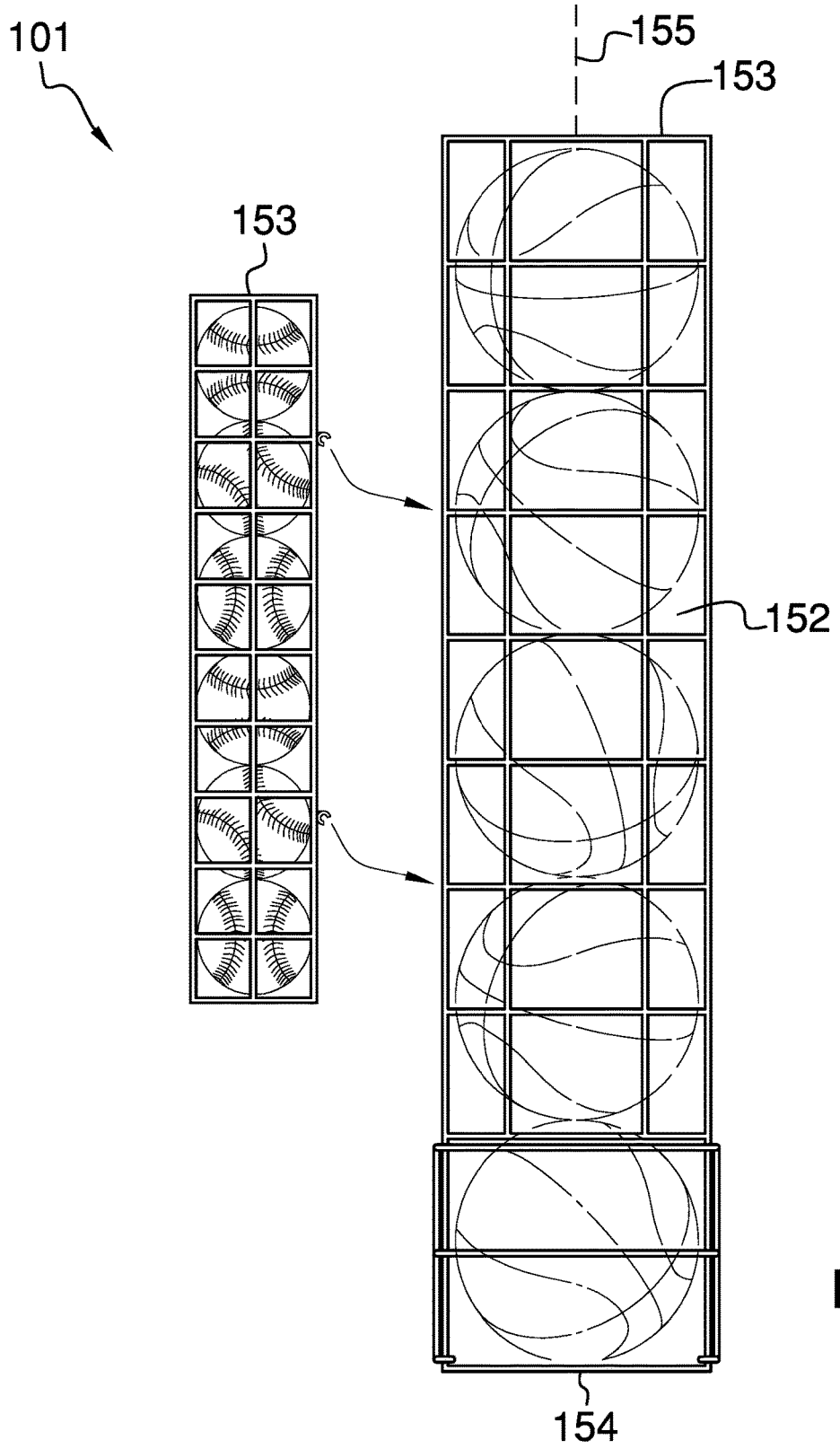
FIG. 7 is a front view of an alternate embodiment of the disclosure.

In the first potential embodiment of the disclosure, the plurality of mounting brackets 103 comprises a first plate 131 and a second plate 132. The first plate 131 is a plate selected from the plurality of mounting brackets 103. The second plate 132 is a plate selected from the plurality of mounting brackets 103. In FIG. 7, alternative embodiments of the invention 100 include smaller versions that can attach to the side of the cage 101. In this scenario, the smaller versions are adapted to store smaller sports ball sizes, such as baseballs or softballs.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Ball: As used in this disclosure, a ball refers to an object with a spherical or nearly spherical shape.

Bifurcate: As used in this disclosure, to bifurcate means to divide an object or space into two pieces or segments.

Bracket: As used in this disclosure, a bracket is a mechanical structure that attaches a second structure to a first structure such that the load path of the second structure is fully transferred to the first structure.

Cage: As used in this disclosure, a cage is an openwork structure that defines an interior volume within which an object may be contained.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Correspond: As used in this disclosure, the term correspond is used as a comparison between two or more objects wherein one or more properties shared by the two or more objects match, agree, or align within acceptable manufacturing tolerances.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Diameter: As used in this disclosure, a diameter of an object is a straight-line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Door: As used in this disclosure, a door is a movable or removable barrier that is attached to the wall of a room or the surface of a container for the purpose of allowing or preventing access through an aperture into the room or container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hook: As used in this disclosure, a hook is an object that is curved or bent at an angle such that items can be hung on or caught by the object.

Horizontal Segment: As used in this disclosure, a horizontal segment refers to a prism or cylinder that is bifurcated by a single plane that is parallel to or contains the center axis of the prism or cylinder.

Inferior: As used in this disclosure, the term inferior refers to a directional reference that is parallel to and in the same direction as the force of gravity.

Inner Diameter: As used in this disclosure, the term inner diameter is used in the same way that a plumber would refer to the inner diameter of a pipe.

Load: As used in this disclosure, the term load refers to an object that upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Openwork: As used in this disclosure, the term open work is used to describe a structure, often a surface, which is formed with openings that allow for visibility and airflow through the structure. Wrought work is a form of openwork.

Outer Diameter: As used in this disclosure, the term outer diameter is used in the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Port: As used in this disclosure, a port is an opening formed in a first object that allows a second object to pass through a boundary formed by the first object.

Radius: As used in this disclosure, a radius refers to a line segment that: 1) connects the center of a circle to the circumference of the circle; or, 2) connects the center of a sphere to the surface of the sphere; or, 3) is one half the span of the diameter of an object.

Superior: As used in this disclosure, the term superior refers to a directional reference that is parallel to and in the opposite direction of the force of gravity.

Suspend: As used in this disclosure, to suspend an object means to support an object such that the inferior end of the object does not form a significant portion of the load path of the object.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A device for storing and dispensing balls comprising:
- a cage, a door, and a plurality of mounting brackets;
- wherein the plurality of mounting brackets attach the cage to a vertical surface;
- wherein the door attaches to the cage;
- wherein the device for storing and dispensing balls is configured for use with one or more balls;
- wherein the device for storing and dispensing balls stores the one or more balls;
- wherein the device for storing and dispensing balls dispenses a ball selected from the one or more balls;
- wherein the cage is a hollow cylindrical openwork structure;
- wherein the cage is further defined with a first inner radius, a lateral face, a superior end, an inferior end, and a center axis;
- wherein the cage attaches to the vertical surface such that the center axis of the cylindrical openwork structure is parallel to the force of gravity;
- wherein the one or more balls are placed into the cage through the superior end of the hollow cylindrical openwork structure;
- wherein the one or more balls are dispensed through the door of the device for storing and dispensing balls;
- wherein each of the plurality of mounting brackets is a bracket that attaches the cage to the vertical surface such that the load path of the cage transfers to the vertical surface;
- wherein each of the plurality of mounting brackets attaches to the openwork of the cage;
- wherein the cage further comprises a door aperture;
- wherein the door aperture is an exit port through which the one or more balls exit the cage;
- wherein the door aperture is an opening formed through the openwork of the lateral face of the cage;
- wherein the door aperture is located at the inferior end of the cage;
- wherein the span of the dimensions of the door aperture are greater than two times the span of the first inner radius of the cage such that a ball selected from the one or more balls will fit through the door aperture;
- wherein the door is formed in a shape that is geometrically similar to a vertical segment of a cylinder;
- wherein the door is a barrier that encloses the door aperture;
- wherein the door comprises a first arm, a second arm, a superior rim, an inferior rim, and a plurality of rings;
- wherein the first arm and the second arm attach the superior rim to the inferior rim;
- wherein each of the plurality of rings attaches to an arm selected from the first arm and the second arm;
- wherein the first arm is further defined with a first end and a second end;
- wherein the second arm is further defined with a third end and a fourth end;
- wherein the superior rim is further defined with a fifth end, a sixth end, and a second inner radius;
- wherein the inferior rim is further defined with a seventh end, an eighth end, and the second inner radius.

2. The device for storing and dispensing balls according to claim 1 wherein the second inner radius of the door is greater than the first inner radius of the cage such that the door will wrap around the exterior of the lateral face of the cage.

3. The device for storing and dispensing balls according to claim 2 wherein the door attaches to the openwork of the cage such that the door slides along the openwork of the door in a direction parallel to the center axis of the cage.

4. The device for storing and dispensing balls according to claim 3
- wherein the first arm is a cylindrical shaft that forms a portion of the perimeter of the door;
- wherein the first arm is a straight structure;
- wherein the first arm is parallel to the center axis of the cage when the door is installed on the cage;
- wherein the first arm attaches the superior rim to the inferior rim;
- wherein the first arm attaches the door to the openwork of the cage.

5. The device for storing and dispensing balls according to claim 4
- wherein the second arm is a cylindrical shaft that forms a portion of the perimeter of the door;
- wherein the second arm is a straight structure;
- wherein the second arm is parallel to the center axis of the cage when the door is installed on the cage;
- wherein the second arm attaches the superior rim to the inferior rim;
- wherein the second arm attaches the door to the openwork of the cage.

6. The device for storing and dispensing balls according to claim 5
- wherein the superior rim forms the superior edge of the door;
- wherein the superior rim is a cylindrical shaft that forms a portion of the perimeter of the door;
- wherein the superior rim is a curved structure that forms the arc of the circumference of a circle with a radius equal to the second inner radius;
- wherein the superior rim is perpendicular to the center axis of the cage when the door is installed on the cage.

7. The device for storing and dispensing balls according to claim 6 wherein the inferior rim is a cylindrical shaft;

wherein the inferior rim is a curved structure that forms the arc of the circumference of a circle with a radius equal to the second inner radius;

wherein the inferior rim is identical to the superior rim;

wherein the inferior rim is perpendicular to the center axis of the cage when the door is installed on the cage.

8. The device for storing and dispensing balls according to claim 7 wherein the fifth end of the superior rim attaches perpendicularly to the first end of the first arm;

wherein the sixth end of the superior rim attaches perpendicularly to the third end of the second arm;

wherein the seventh end of the inferior rim attaches perpendicularly to the lateral exterior face of the first arm;

wherein the eighth end of the inferior rim attaches perpendicularly to the lateral exterior face of the second arm.

9. The device for storing and dispensing balls according to claim 8 wherein each of the plurality of rings is a loop that attaches an arm selected from the group consisting of the first arm and the second arm to the openwork of the cage;

wherein the door attaches to the cage by inserting a bar of the openwork that forms the cage through a ring selected from the plurality of rings.

10. The device for storing and dispensing balls according to claim 9 wherein the plurality of rings attach the door to the cage such that the door will slide in a direction that is parallel to the center axis of the cage.

11. The device for storing and dispensing balls according to claim 10 wherein the plurality of rings comprises a first ring and a third ring;

wherein the first ring is a loop selected from the plurality of plurality of rings that attaches to the lateral exterior face of the first arm proximal to the seventh end of the inferior rim;

wherein the first ring attaches to the side of the first arm that is proximal to the center of the circle that forms the circular arcs of the superior rim and the inferior rim;

wherein the face formed by the first ring is perpendicular to the center axis of the cage;

wherein the third ring is a loop selected from the plurality of plurality of rings that attaches to the lateral exterior face of the second arm proximal to the eighth end of the inferior rim;

wherein the third ring attaches to the side of the second arm that is proximal to the center of the circle that forms the circular arcs of the superior rim and the inferior rim;

wherein the face formed by the third ring is perpendicular to the center axis of the cage.

12. The device for storing and dispensing balls according to claim 11 wherein the plurality of rings comprises a second ring and a fourth ring;

wherein the second ring is a loop selected from the plurality of plurality of rings that attaches to the second end of the first arm;

wherein the second ring attaches to the second end of the first arm at a location proximal to the center of the circle that forms the circular arcs of the superior rim and the inferior rim;

wherein the face formed by the second ring is perpendicular to the center axis of the cage;

wherein the fourth ring is a loop selected from the plurality of plurality of rings that attaches to the fourth end of the second arm;

wherein the fourth ring attaches to the fourth end of the second arm at a location is proximal to the center of the circle that forms the circular arcs of the superior rim and the inferior rim;

wherein the face formed by the fourth ring is perpendicular to the center axis of the cage.

13. The device for storing and dispensing balls according to claim 12 wherein the plurality of mounting brackets comprises a collection of individual plates;

wherein any first individual plate selected from the plurality of mounting brackets is identical to any second individual plate selected from the plurality of mounting brackets.

14. The device for storing and dispensing balls according to claim 13 wherein each individual plate comprises a base plate and a hook;

wherein the hook attaches to the base plate;

wherein the base plate attaches to the vertical surface;

wherein the hook attaches to and supports the openwork of the cage.

15. The device for storing and dispensing balls according to claim 14 wherein the base plate is a rectangular plate structure;

wherein the hook is a curved structure.

* * * * *